United States Patent [19]

Seinecke

[11] 4,044,319

[45] Aug. 23, 1977

[54] COAXIAL 2-OF-N RELAY TRANSFER SWITCH HAVING REED CONTACTS

[75] Inventor: Siegfried Seinecke, Soecking, Germany

[73] Assignee: Siemens Aktiengesellschaft, Berlin & Munich, Germany

[21] Appl. No.: 688,889

[22] Filed: May 21, 1976

[30] Foreign Application Priority Data

Sept. 30, 1975 Germany ..... 2543675

[51] Int. Cl.[2] ..... H01P 1/10

[52] U.S. Cl. ..... 333/7 R; 335/5

[58] Field of Search ..... 333/7 R; 335/4, 5, 152

[56] References Cited

U.S. PATENT DOCUMENTS 3,461,386 8/1969 McCutcheon et al. ..... 335/5 X

*Primary Examiner*—Paul L. Gensler

*Attorney, Agent, or Firm*—Hill, Gross, Simpson, Van Santen, Steadman, Chiara & Simpson

[57] ABSTRACT

A coaxial 2-of-n relay transfer switch has reed contacts arranged in electrically conductive, non-magnetic tubes. The reed contacts (reed switches) are arranged in two groups of *n* reed switches in each group in a star configuration with the reed switches of each group forming the edges of a pyramid. One end of each reed switch of a group is connected to the like end of the other reed switches of that group to form a first branching point to a respective coaxial input line. The other end of each reed switch is connected to a like end of a reed switch in the other group to form a respective second branching point to a respective coaxial output line. Each of the first branching points is encased in a metallic head and the metallic heads and the tubes are constructed with interior walls which provide added inductance between the inner conductor of the respective coaxial input line and the first branching points, on one hand, and, on the other hand, between the first branching points and the contacts of the reed switches of the groups.

8 Claims, 3 Drawing Figures

COAXIAL 2-OF-n RELAY TRANSFER SWITCH HAVING REED CONTACTS

CROSS REFERENCE TO RELATED APPLICATION

This application is related to my application entitled "A Coaxial **1-of-*n*** Relay Transfer Switch Having Reed Contacts," filed on even date herewith Ser. No. 688,888.

BACKGROUND OF THE INVENTION

1. Field of the Invention

The present invention relates to a coaxial **2-of-*n***-relay transfer switch having reed contacts arranged in electrically conductive, non magnetic tubes, which contacts are arranged in two groups to each *n* reed contacts in a star shape in such a way that, per group, the one contact spring terminals meet in a branching point and, in a metallic head encompassing the branching point, are connected in common to a coaxial input line, and that the, in each case, other contact spring terminals of mutually corresponding reed contacts of both groups meet in pairs in second branching points and are there connected to output lines, and in which the metallic heads and the metallic tubes encompassing the reed contacts are so designed in their interior that, seen electrically, additional inductances are inserted on the one hand between the end of the inner conductor of the coaxial input line and the first branching point of the reed contacts and, on the other hand, between the first branching point and the contact points of the reed contacts.

2. Description of the Prior Art

In test devices for rapid digital switching circuits, it is often the task to connect, in a program-controlled fashion, one of *n* input terminals of a test object to the output of a generator and to the one input of an oscillograph via coaxial lines and transfer switches. The connection therein is to be done in such a fashion that down to signal rise times of 0.5 ns, the network formed in each case represents, to the greatest degree possible, a reflection-free, wide band 50 ohm coaxial connection of a specific electrical length. At the same time, a selected other one of the *n* input terminals of the test object must be able to be connected to the output of a second generator. The technical solution for this problem is usually to be found in relay matrices having two inputs and *n* outputs (for example, where *n* equals 64) which are composed of individual **2-of-*n*** relay transfer switches connected in cascade (for example, three transfer switches in cascade with a branching number of four per stage).

FIG. 1 shows the principle wiring diagram of such a 2-of-4 relay transfer switch. Two coaxial input lines E1 and E2 can be connected via, in each case, one of the four relay-controlled reed contacts ***r*1. . .*r*4 or, respectively, of the four relay-controlled reed contacts *k*1. . .*k*4**, to one of four coaxial output lines in such a way that in both transmission directions it is possible to have pulse transmission which is as reflection-free as possible, with low distortion and low attenuation. For specifically this type of transfer switch, no practical solutions have as yet become known which lead to the desired wide band character.

A 2-of-4 transfer switch has become known in which, on the top side of a multi-layer printed circuit board, four reed contacts are arranged in a star shape and the branching point of the reed contacts on the top of the multi-layer printed circuit board is surrounded by a metallic head into which, from the underside of the multi-layer printed circuit board, a coaxial plug connection is inserted. On the same printed circuit board a second metallic head with four further reed contacts is arranged on the bottom side. The feed into this second head is accomplished from the top via a second coaxial plug connection which leads to the branching point of the second four reed contacts.

The two-times-four reed contacts are connected to coaxial output plug connections in that the connecting legs of corresponding reed contacts are connected to soldering eyes, and from the soldering eyes, 50 ohm strip lines lead to the coaxial output plug connections. In order to transfer the quasi-coaxial line, which the inside conductor forms together with the copper tube encompassing the reed contacts, as shock free as possible into the 50 ohm strip line in the region of the soldering eyes, the tube ends are connected via wires and other soldering eyes to the ground plane of the printed circuit board.

For the following reasons, arrangements of this type cannot be produced sufficiently low in reflection and wide band enough:

1. The necessary lateral displacement of the two heads, which is necessary to that the feed-in lines can be connected to the coaxial input plug connections, causes the connections of the reed contacts to the soldering eyes to be unequally formed and, therefore, only to a limited degree electrically equally long.
2. The junctions from the reed contacts onto the 50 ohm strip lines with, in each case, a contact connecting wire and a zero-volt wire are shock-afflicted.
3. The soldering eyes disturb the lines with a capacity of about 2 pF against zero volts.
4. The junctions from the 50 ohm strip lines to the output sockets are shock-afflicted.

For this reason, fundamental reflections $>20\%$ (at 150 ps generator rise time), a bandwidth of $<1$ GHz and residual time constants $<500$ ps are to be expected; and the transit time differences of the individual paths lie above 20 ps.

SUMMARY OF THE INVENTION

The present invention therefore has the underlying objective of creating a **2-of-*n* relay transfer switch, having reed contacts, which is extremely wide band, has a low-reflection characteristic and, in addition, has slight transit time differences between the individual paths. Furthermore, the 2-of-*n*** relay transfer switch is to be able to be produced and installed as a module with uniform, tight-tolerance electrical data.

According to the invention, this objective is accomplished in that the reed contacts are arranged in such a way that they form the edges of a double pyramid. Especially good electrical characteristics are achieved in those cases when the contact spring terminals meeting in the second branching points are connected to a respective output line in a respective metallic pot-shaped member; and additional inductances are inserted, in each case, between the contact points of the reed contacts and the second branching point on the one hand as well as, on the other hand, between the branching point and the end of the inside conductor of the output line, seen electrically.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF A PREFERRED EMBODIMENT

Figure 1:
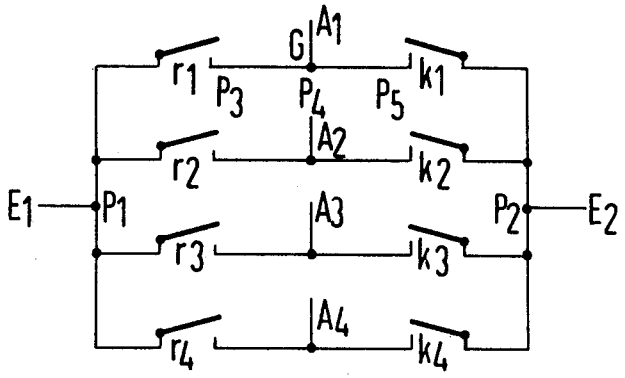
FIG. 1 is a fundamental wiring diagram of a 2-of-4 relay transfer switch.
Figure 2:
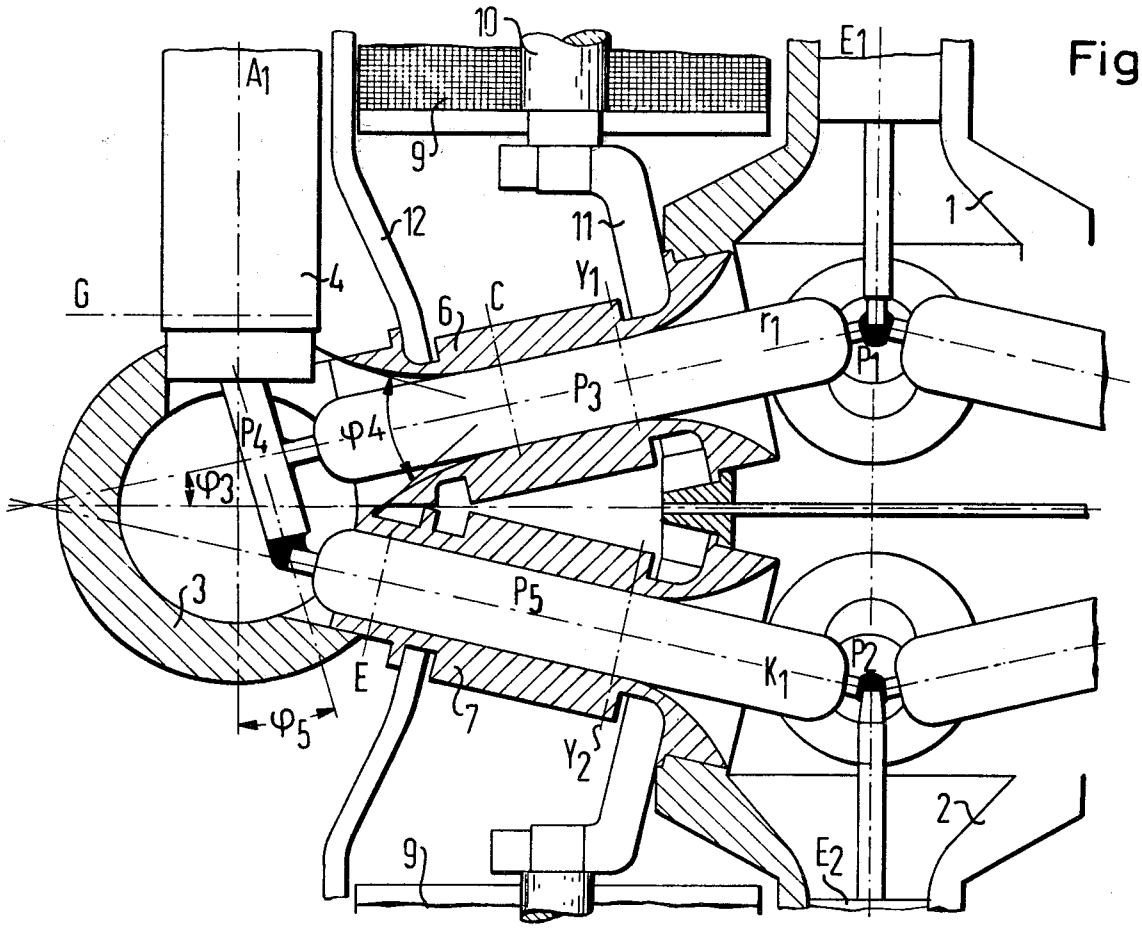
FIG. 2 is an arrangement and structuring of the tubes enclosing the reed contacts and of the pot-shaped members enclosing the second branching points, shown partially in section and thereby illustrating only six of eight reed contacts.

FIG. 2 shows the constructional accomplishment of an relay transfer switch constructed in accordance with the invention. The two heads 1 and 2 represent the two first branchings to, in each case, four contacts at $P_1$ and $P_2$ in FIG. 1. From the top and, respectively, from the bottom, the input lines $E_1$ and $E_2$ connect into the heads. The four reed contacts each do not extend radially from the heads but rather are inclined inward by an angle $\phi_3$ and extend in pairs into a respective pot-shaped member 3. In FIG. 2, the two reed contacts extending to the left are the switches $r_1$ and $k_1$ of FIG. 1. Thus, the element 4 is the axially departing output line $A_1$.

The quadruple branching points $P_1$ and $P_2$ in FIG. 2 are, according to the principles of the invention, designed like the branching points of a proposed 1-of-4 transfer switch. In addition, there is a further branching point $P_4$, only double however, which is electrically separated from the branching points $P_1$ and $P_2$ by interposed reed contacts and whose additional reflection is to be kept small. If the reed contacts $r_1$ are initially closed in order to connect the input $E_1$ with the output $A_1$, the contacts $k_1$ are open, then (aside from the branch at $P_1$) only the open, left contact spring (the path $P_4$—$P_5$) of the reed contact $k_1$ functions as a top line (capacitive disruption $C_{P4-P5}$) at the through-connected line (path) $E_1$—$P_1$—$P_3$—$P_4$—$A_1$. If, conversely, the contacts $r_1$ are open and the contacts $k_1$ are closed, then (aside from the branching at $P_2$) only the open, left contact spring (path $P_4$—$P_3$) of the contacts $r_1$ functions as a disruptive capacitance $C_{P4-P3}$ at the line (path) $E_2$—$P_2$—$P_5$—$P_4$—$A_1$.

Figure 3:
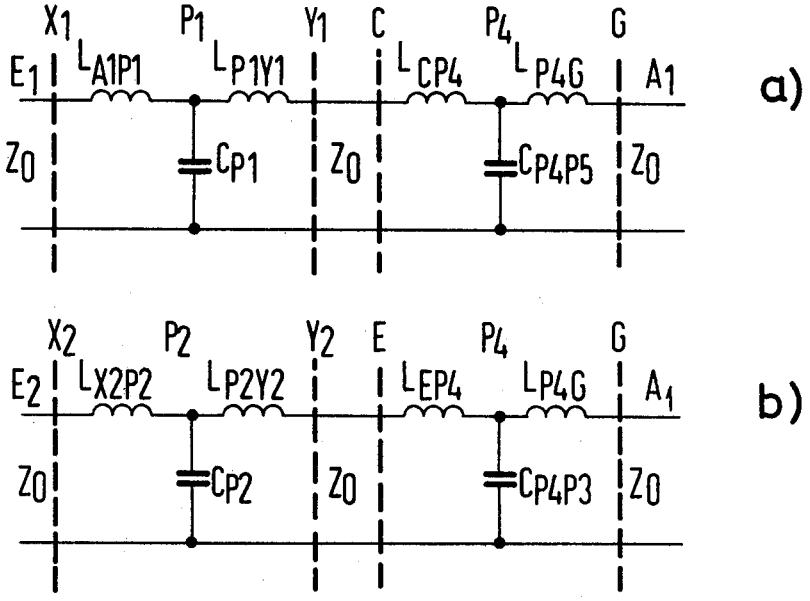
FIG. 3 is an equivalent electrical circuit diagram.

The interference capacitance at the point $P_4$ is much smaller than in the head 1 or, respectively, the head 2, since in each case only one open relay contact interferes and not three. Nevertheless, a compensation by series inductances as per FIG. 3 is advantageous. In diagram (a) of FIG. 3 the left T-section represents head 1 alone. The zone $Y_1$—C is a piece of 50 ohm coaxial line. The right T-section represents the passage through the pot-shaped member 3 (between zone ends C and G). In the schematic circuit diagram (*b*) of FIG. 3 for the other case, the right T-section is different from diagram (*a*) of FIG. 3, because the output line 4 leading away in an upward direction creates unequal routes so that the capacitance $C_{P4-P5}$ becomes greater than the capacitance $C_{P4-P3}$.

In order to compensate it is expedient to bend the center conductor of the output line 4 to the reed contacts (the angle $\phi_5$, reduces above all the capacitance $C_{P4-P5}$), and also to give tube 6 a funnel-shaped expansion toward the left ($\phi_4$, reduces $C_{P4-P3}$ and increases $L_{CP4}$), while tube 7 extends directly into the pot-shaped member 3. In the ideal case, all four T-sections of FIG. 3 have a wave resistance $Z_o$ of 50 ohm. The zone $Y_2$-E is a 50 ohm-coaxial line.

For space reasons the operating windings 9 cannot be arranged on the reed switches, but rather they group themselves axially around $E_1$ and $E_2$, respectively, the magnetic flux of each coil is coupled by the core 10 as well as conductive fins 11 and 12 of soft iron to the appertaining reed contact.

Although I have described my invention by reference to specific illustrations, many changes and modifications of the invention may become apparent to those skilled in the art without departing from the spirit and scope of the invention. I therefore intend to include within the patent warranted hereon all such changes and modifications as may be reasonably and properly be included within the scope of my contribution to the art.

I claim:

1. A coaxial **2-of-*n*** relay transfer switch arrangement, where *n* is an integer comprising first and second coaxial input lines and *n* coaxial output lines each including an inner conductor and an outer conductor, first and second groups of reed switches, each group including *n* reed switches arranged generally in the shape of a star with said reed switches forming the edges of a pyramid, each of said reed switches including reed contacts, a first reed terminal connected in common with the like terminals in the same group to form two first branching points, one for each of said groups, each first branching point connected to an inner conductor of a respective input line, and a second reed terminal which is connected to a like terminal from the other group to form *n* second branching points, each of said second branching points connected to said inner conductor of a respective output line, a plurality of non-magnetic metallic tubes, each of said tubes housing a respective reed switch, a pair of metallic heads, each of said heads enclosing a respective first branching point and connected to an outer conductor of a respective input line and serving with that branching point as a respective coaxial input, the ends of said metallic tubes adjacent a second branching point electrically connected to said outer conductor of a respective output line and serving with the respective branching point as a coaxial output, said metallic tube and metallic heads electrically connected and including interior constructions which electrically add inductance between said input line inner conductors and said first branching points and between said first branching points and the respective reed contacts in each group.

2. A coaxial **2-of-*n* relay transfer switch arrangement according to claim 1,** comprising:

a plurality of metallic pot-shaped members each enclosing a respective second branching point and electrically connected to and adapting the respective metallic tubes to said outer conductor of the respective output line.

3. A coaxial **2-of-*n* relay transfer switch arrangement according to claim 2,** wherein said metallic pot-shaped members and metallic tubes are constructed to add inductance between said inner conductor of a respective output line and the respective second branching point, and between said second branching point and the respective reed contacts.

4. A coaxial **2-of-*n* relay transfer switch arrangement according to claim 3,** wherein said output lines extend parallel to said input lines.

5. A coaxial **2-of-*n* relay transfer switch arrangement according to claim 4,** wherein said tubes which are nearer said output lines includes an exponential horn-shaped interior surface.

6. A coaxial **2-of-*n* relay transfer switch arrangement according to claim 3,** wherein the inner ends of said tubes have an exponential horn shape.

7. A coaxial **2-of-*n* relay transfer switch arrangement according to claim 6,** wherein said inner conductor of each of said output lines is bent at an angle toward the respective reed switches.

8. A coaxial **2-of-*n*** relay transfer switch arrangement, where $n$ is an integer comprising $n + 2$ coaxial lines, each of said lines including an inner conductor and an outer conductor, first and second groups of reed switches, each group including $n$ reed switches arranged generally in the shape of a star with said reed switches forming the edges of a pyramid, each of said reed switches including reed contacts, a first reed terminal connected in common with the like terminals in the same group to form two first branching points, one for each of said groups, each first branching point connected to an inner conductor of respective first and second ones of said lines, and a second reed terminal which is connected to a like terminal from the other group to form $n$ second branching points, each of said second branching points connected to said inner conductor of the respective other ones of said lines, a plurality of non-magnetic metallic tubes, each of said tubes housing a respective reed switch, a pair of metallic heads, each of said heads enclosing a respective first branching point and connected to an outer conductor of the respective first and second lines, the ends of said metallic tubes adjacent a second branching point electrically connected to said outer conductor of a respective other line, said metallic tube and metallic heads electrically connected and including exponentially flared interior surfaces which electrically add inductance between said first and second line inner conductors and said first branching points and between said first branching points and the respective reed contacts in each group.

* * * * *